US005183978A

United States Patent [19]

Sheridan et al.

[11] Patent Number: 5,183,978

[45] Date of Patent: Feb. 2, 1993

[54] ELEVATOR GOVERNOR ROPE BLOCK ACTUATION IN LOW SPEED EMERGENCY SITUATIONS

[75] Inventors: William G. Sheridan, Southington; Edward D. Reiskin, West Hartford, both of Conn.

[73] Assignee: Otis Elevator Company, Farmington, Conn.

[21] Appl. No.: 679,873

[22] Filed: Apr. 3, 1991

[51] Int. Cl.[5] ..... B66B 5/00; B66B 5/02

[52] U.S. Cl. ..... 187/105; 187/109

[58] Field of Search ..... 187/57, 105, 109

[56] References Cited

U.S. PATENT DOCUMENTS

| | | | |
|---|---|---|---|
| 4,529,065 | 7/1985 | Kraft | 187/57 |
| 4,785,914 | 11/1988 | Blain et al. | 187/105 |
| 4,923,055 | 5/1990 | Holland | 187/109 |

OTHER PUBLICATIONS

Lubomir Janovsky "Elevator Mechanical Design, Principles and Concepts" International Assoc. of Elevator Engineers, Ellis Horwood Limited Chichester (1987).

*Primary Examiner*—A. D. Pellinen
*Assistant Examiner*—Fritz M. Fleming
*Attorney, Agent, or Firm*—William W. Jones

[57] ABSTRACT

The governor ropes on an elevator are actuated by an emergency tripping system when motion away from a landing zone of the car is detected while the car doors remain open. If the elevator controller receives a "door open" signal and a "car moving out of landing zone" signal concurrently, a solenoid tripper is actuated which causes the governor rope blocks to set on the governor ropes thereby activating the car's emergency brakes. Conventional governor actuation systems can be retrofitted with the solenoid tripper of this invention.

4 Claims, 5 Drawing Sheets

ELEVATOR GOVERNOR ROPE BLOCK ACTUATION IN LOW SPEED EMERGENCY SITUATIONS

TECHNICAL FIELD

This invention relates to a system for stopping an elevator car if it moves out of a landing zone with its doors open.

BACKGROUND ART

Elevator safety codes are being enacted that require that an elevator car be stopped if it moves out of a landing zone while its doors are still open. Thus protection against car movement when the car is at a landing is being sought. Such car movement can happen when control over the traction machine is lost, as when a gear or other part of the machine breaks. U.S. Pat. No. 4,923,055 granted May 8, 1990 to G. A. Holland discloses a mechanism for preventing unintended motion in traction elevators, which mechanism addresses the problems of overspeed and also movement of the car from a landing with the car doors open. The Holland mechanism uses a trigger which is selectively armed when the car is stopped, or when overspeed occurs, and which is tripped by contact with a cam or ratchet tooth on the governor sheave or on the traction sheave. If the trigger is not properly armed, then the mechanism will not operate. Additionally, this device is a fail-safe device which will trip any time the power goes off, thereby requiring frequent manual resetting. There are many delay circuits in the system to prevent false tripping. Finally, the complexity of this patented system prevents a simple retrofit onto existing elevators, since special parts, as for example the special sheaves, must be used.

DISCLOSURE OF THE INVENTION

This invention relates to a system for tripping the governor rope safety blocks in the event of car motion while the car doors are open, so that the governor rope will set the emergency brakes on the car or counterweight. Governors for both the car and counterweight can be fitted with the system of this invention. The system includes a solenoid which acts on the tripping crank of the standard governor rope safety blocks. The solenoid is connected to the elevator controller and is normally inoperable to affect operation of the governor rope blocks. When the controller senses motion of the car while the car doors are open, a signal is sent to the solenoid and it acts directly on the safety block tripping crank so that the safety blocks are brought to bear against the governor rope whereby the emergency brakes on the car or counterweight, or both, are set to stop car and/or counterweight movement in the hoistway.

It is therefore an object of this invention to provide an elevator safety system which assures stoppage of the car and/or counterweight upon detection of car movement while the car doors are open.

It is a further object of this invention to provide an elevator safety system of the character described which can be retrofitted onto an existing elevator assembly and has a minimum of additional parts.

It is a further object of this invention to provide an elevator safety system of the character described wherein the overspeed governor rope blocks are directly actuated electrically when door open car movement is detected.

These and other objects and advantages of the invention will become more readily apparent from the following detailed description of a preferred embodiment thereof when taken in conjunction with the accompanying drawings, in which:

BEST MODE FOR CARRYING OUT THE INVENTION

Figure 1:
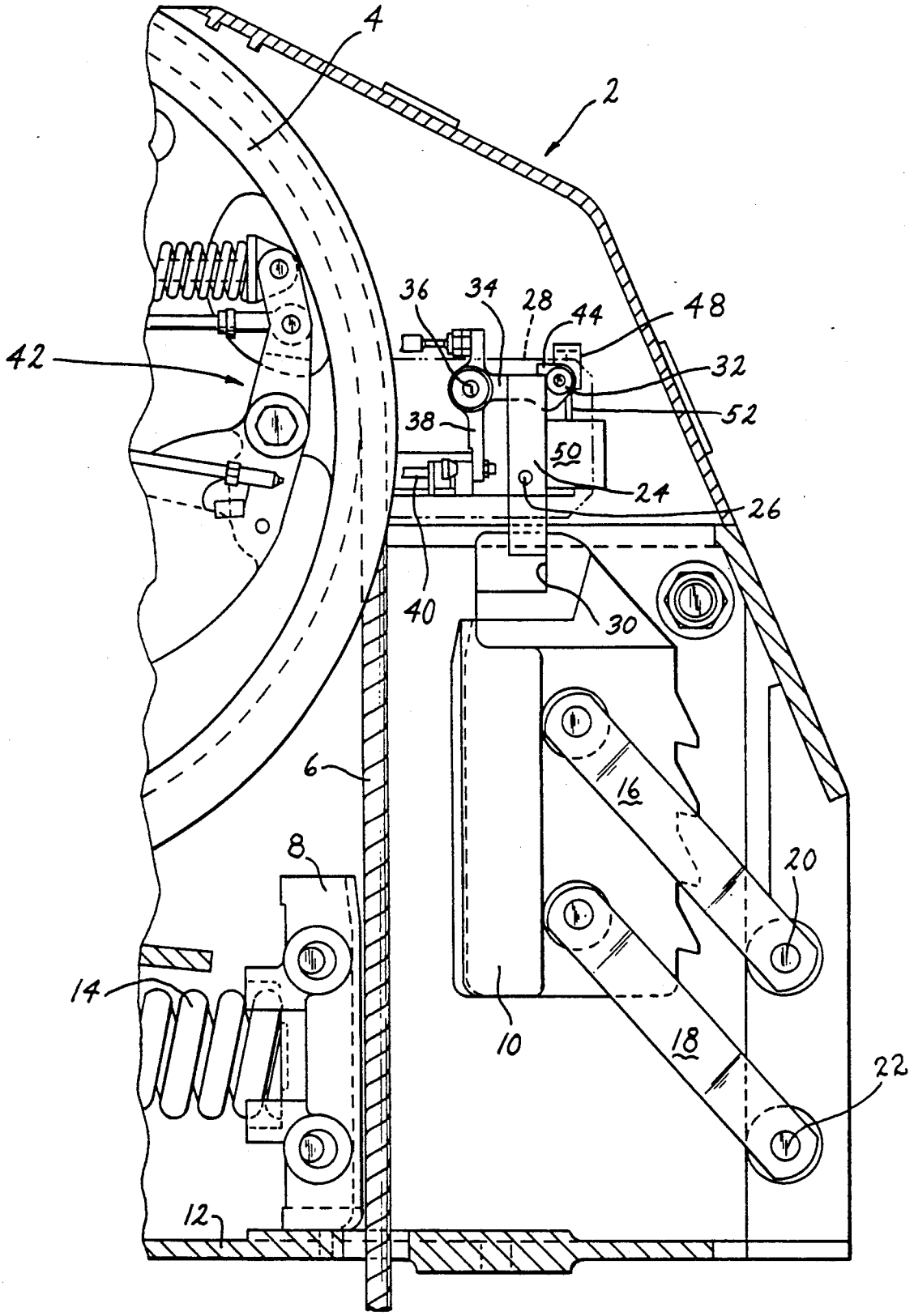
FIG. 1 is a fragmented sectioned side elevational view of the governor sheave housing and emergency brake assembly which incorporates the improvement of this invention.
Figure 2:
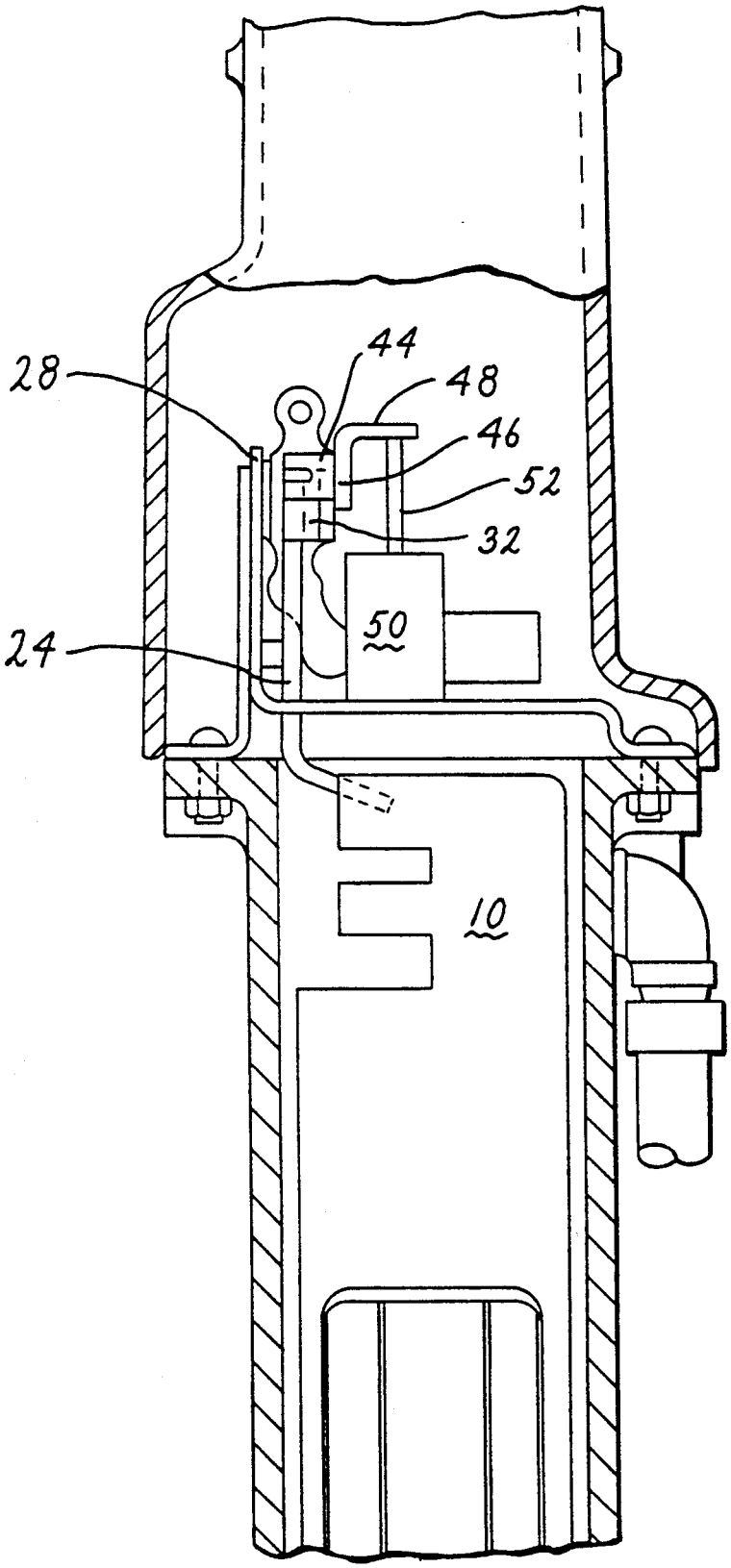
FIG. 2 is a fragmented sectioned end elevational view of the assembly as viewed from the right hand side of FIG. 1.
Figure 7:
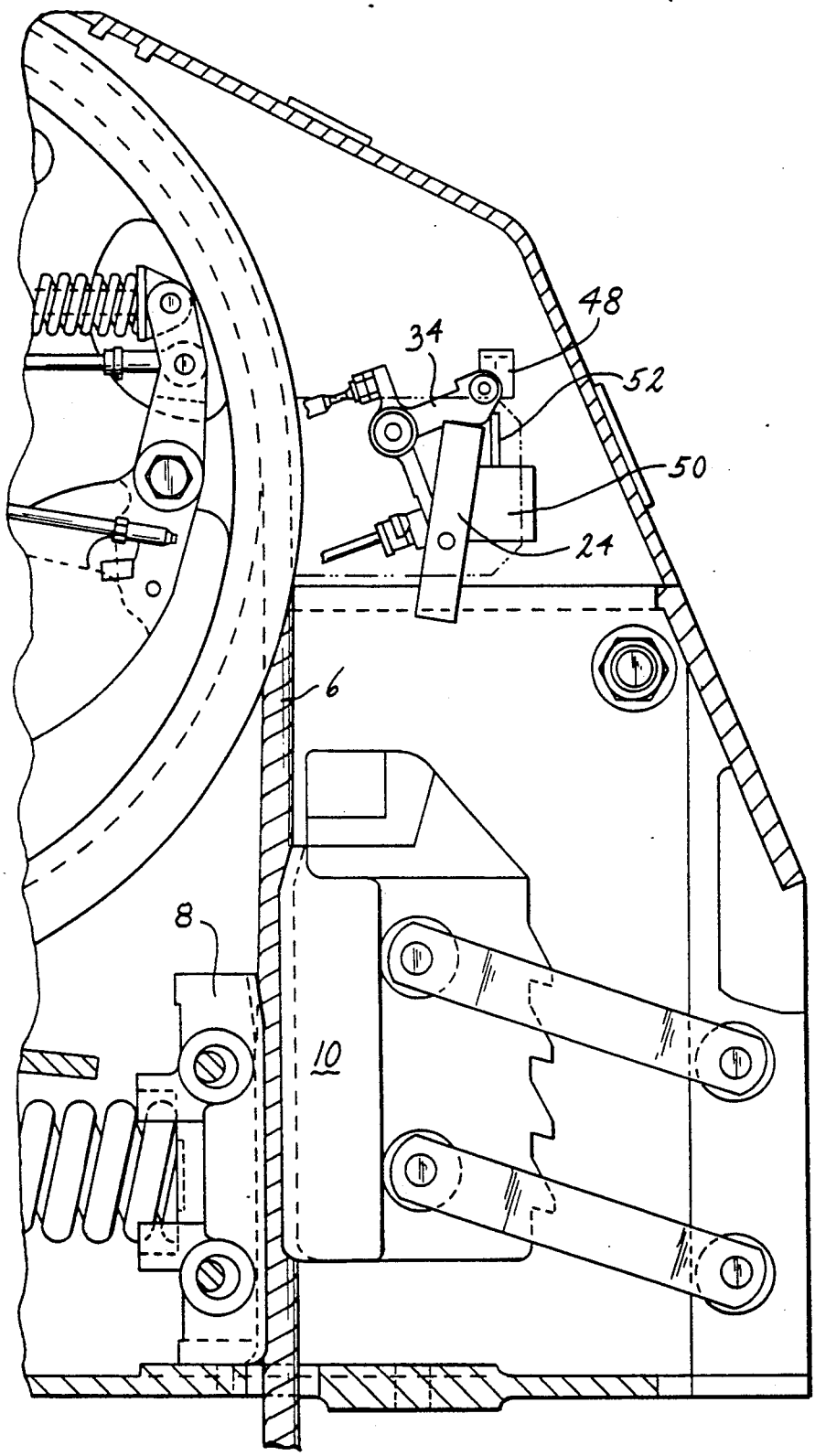
FIG. 7 is a view similar to FIG. 1 but showing the emergency governor rope brake assembly tripped to actuate the car or counterweight emergency brakes.

Referring now to FIGS. 1 and 2, there is shown a portion of a governor sheave housing 2 in which the governor cable sheave 4 is mounted. The governor cable or rope 6 is reaved about the sheave 4 and passes downwardly into the hoistway and about a second sheave in the hoistway pit. A pair of rope blocks 8 and 10 are disposed in the housing 2 on either side of the governor rope 6. The block 8 is mounted on the floor 12 of the housing 2 and is biased by a spring 14 toward the governor rope 6. The block 10 is carried on a pair of levers 16 and 18 which are pivotally mounted in the housing 2 on pins 20 and 22, respectively. In the state shown in FIG. 1, the governor rope 6 is free to move in either direction, up or down, unimpeded by the blocks 8 and 10 since the block 10 is held away from the rope 6 by a latch lever 24. The latch lever 24 is pivoted about a pin 26 on a plate 28 (shown in phantom in FIG. 1), with the lever 24 engaging a catch surface 30 on the block 10. It will be appreciated that the lever 24 is being urged about the pin 26 in a clockwise direction by the weight of the block 10 which by gravity wants to swing downwardly toward the block 8 and governor rope 6. Pivoting of the lever 24 is prevented by a roller 32 which engages the top of the lever 24, and which is mounted on a release crank 34 which pivots on the plate 28 about a pin 36. The crank 34 is normally in the position shown in FIG. 1 wherein the block 10 is held away from the block 8 and rope 6. The crank 34 includes a downwardly extending arm 38 to which is connected a mechanical actuating rod 40. The actuating rod is operably connected in a conventional manner to a flyweight assembly 42 mounted on the governor rope sheave 4. When governor rope overspeed is detected in the downward direction, the flyweight assembly 42 moves radially outwardly and pushes the rod 40 to the right, as viewed in FIG. 1. This causes the crank 34 to pivot in the counterclockwise direction about the pin 36, which in turn lifts the roller 32 away from the lever 24, thereby allowing the block 10 to drop into locking engagement with the rope 6 and block 8. This stops movement of the rope 6, pulling up on the car or counterweight emergency brakes, thereby stopping downward movement of the car or counterweight. The aforesaid mechanical actuation of the governor rope blocks is conventional in the prior art. The result of mechanical actuation is shown in FIG. 7.

Referring specifically to FIG. 2, the roller 32 is mounted in a cover 44 which provides a surface 46 to which a bracket 48 is welded. A solenoid tripper 50 is positioned below the bracket 48 and operates an actuating rod 52 which contacts the bracket 48 which represents a fixed stop means and forms a reaction surface for engagement by the rod 52. The rod 52 is normally retracted, as shown in FIGS. 1 and 2, when the elevator is operating under normal conditions.

Figure 3:
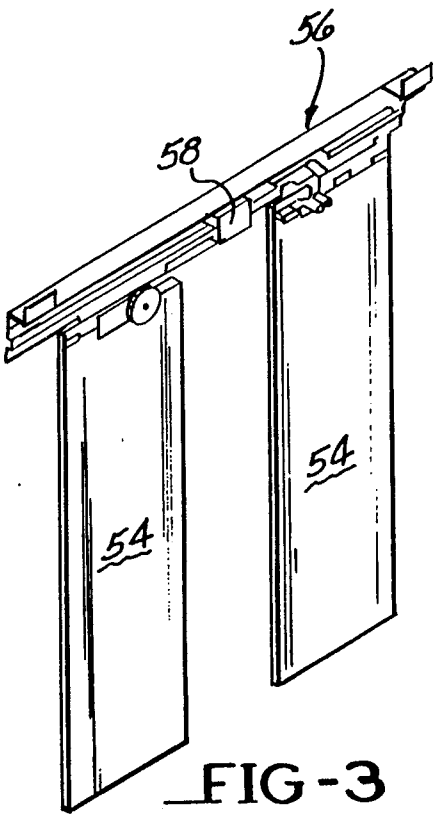
FIG. 3 is a fragmented perspective view of the car door system in the elevator.
Figure 5:
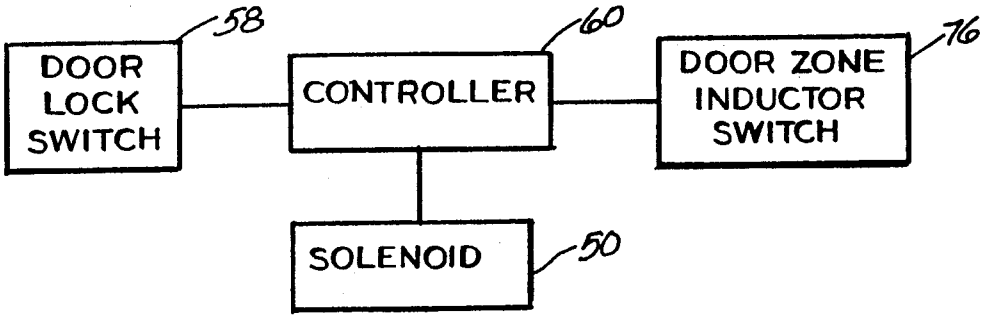
FIG. 5 is a schematic diagram of the circuitry between the elevator controller, door lock and inductor switches, and the emergency governor rope block solenoid.
Figure 4:
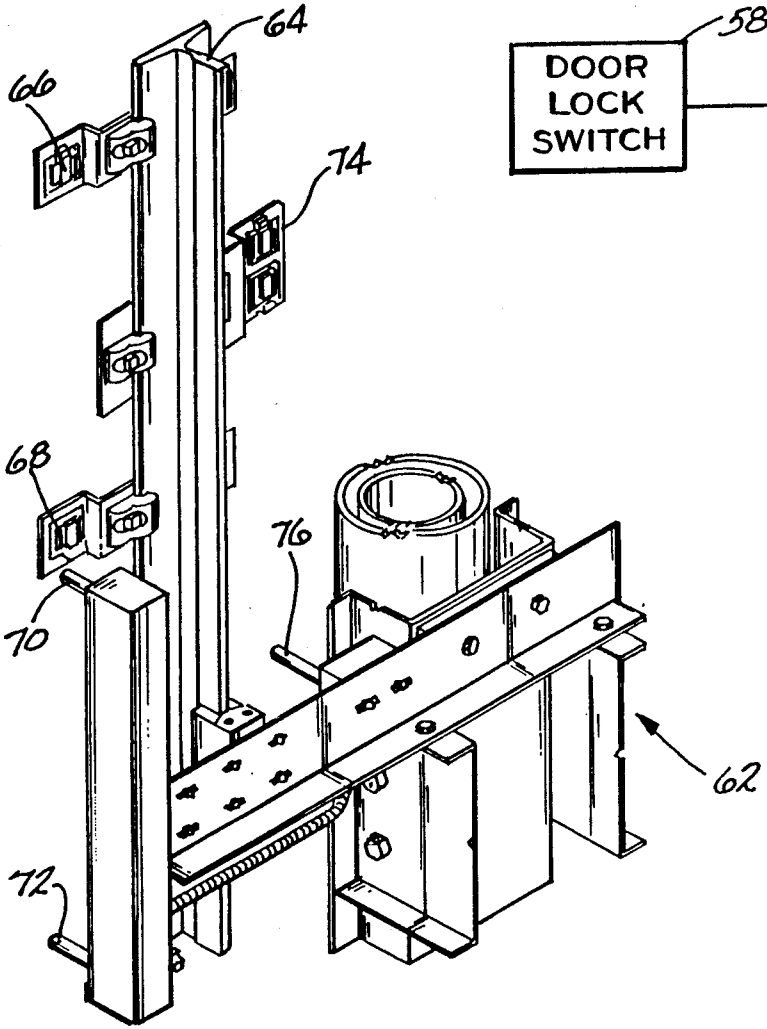
FIG. 4 is a fragmented perspective view of hoistway hall door zone sensing system in the elevator.
Figure 6:
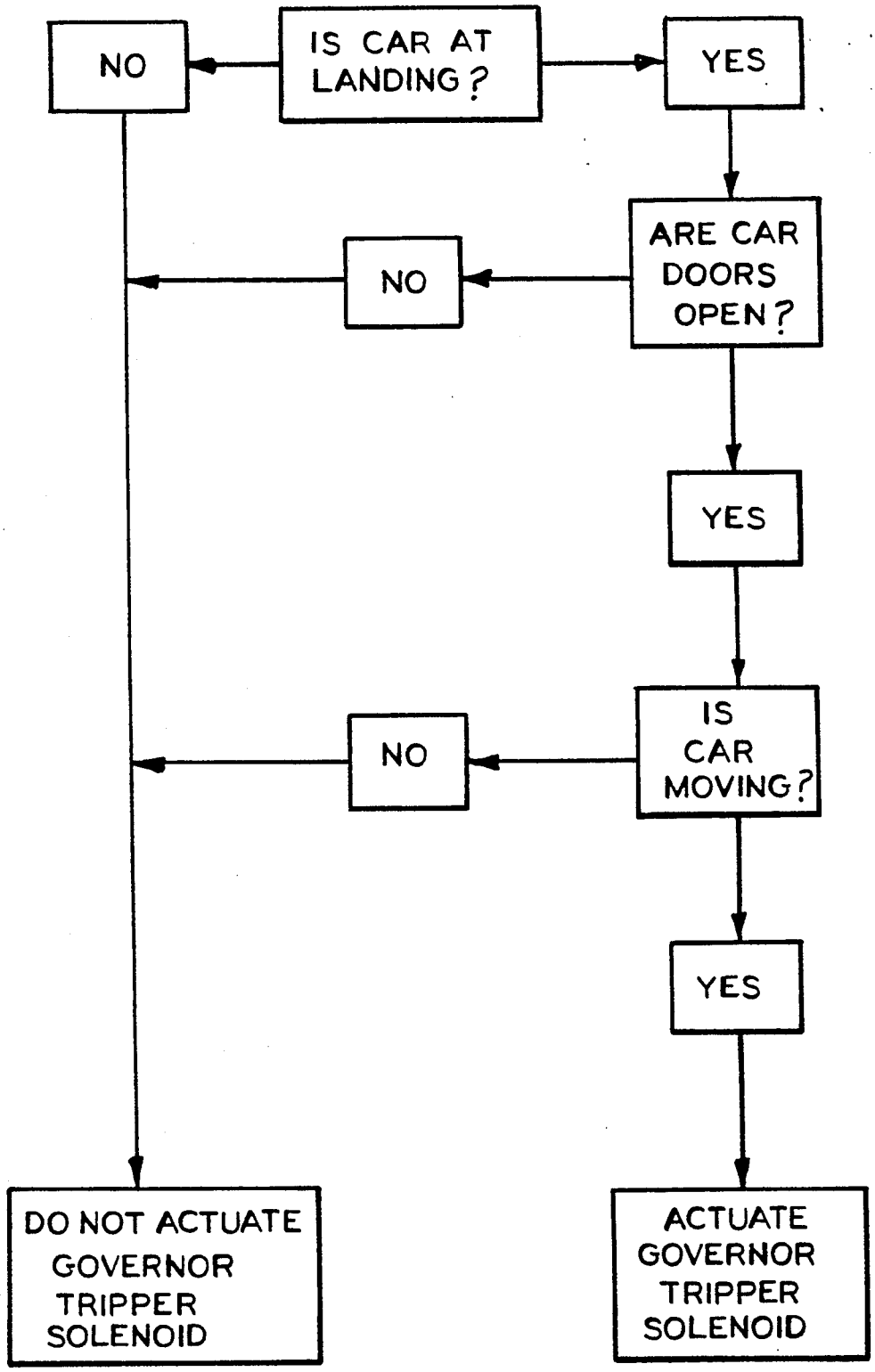
FIG. 6 is a flow chart of the software in the elevator controller which operates the emergency safety of this invention.

Referring to FIGS. 3-5, the elevator car doors 54 are mounted on tracks 56 for movement toward and away from each other. A door lock switch sensor 58 is mounted in the center of the tracks 56 and serves to lock the doors 54 when they are closed. The door lock switch 58 is connected to the elevator controller 60, which includes a microprocessor that controls operation of the elevator. As seen in FIG. 4, the elevator car assembly 62 moves up and down in the hoistway on guide rails 64. At each hall door landing there are a plurality of magnets mounted on the rails 64 which interact with inductor switches mounted on the car assembly 62. The upper and lower magnets 66 and 68 cooperate with upper and lower inductor switches 70 and 72 respectively to control leveling of the car assembly 62 at the hall door. The door zone magnet assembly 74 cooperates with a door zone inductor switch sensor 76 to determine that the car is in the door zone. The door zone inductor switch 76 is connected to the controller 60. When the car is properly positioned in the hall door zone, the inductor switches 70, 72 and 76 signal the controller 60 which then activates the door opening motor (not shown) mounted on the car assembly 62 and door lock switch 58 whereby the car doors 54 will be opened. The controller microprocessor then monitors the condition of the car as set forth in FIG. 6. If the controller 60 detects car movement when the car doors are open, a signal is sent to the solenoid 50, whereupon the solenoid 50 is energized to drive the push rod 52 up against the bracket 48. This causes the crank 34 to pivot to the position shown in FIG. 7 thereby releasing the lever 24 and allowing the block 10 to drop against the governor rope 6 and block 8.

It will be readily appreciated that the emergency governor rope brake tripper of this invention is ultimately simple and operates immediately upon command of the controller. The only moving part is the solenoid push rod, and the tripper is completely unaffected by operation of the mechanical overspeed tripper. The tripper of this invention is only activated when door-open car movement is detected, and at all other times is completely passive. In this manner, minimal wear and tear is imposed on the tripper, contrary to the tripper system disclosed in the aforesaid prior art.

Since many changes and variations of the disclosed embodiment of the invention may be made without departing from the inventive concept, it is not intended to limit the invention otherwise than as required by the appended claims.

What is claimed is:

1. In an elevator system, an elevator governor rope emergency brake assembly for stopping governor rope movement upon the occurrence of a low speed emergency condition in an elevator car, said assembly comprising:

a) a governor sheave over which the governor rope passes;

b) block means adjacent to the governor sheave for selectively engaging and braking the governor rope against movement;

c) latch means for holding said block means in a brake-off condition;

d) release means for disabling said latch means to set said block means on the governor rope;

e) mechanical means on said governor sheave for actuating said release means in the event of governor sheave overspeed;

f) a solenoid tripper adjacent to said release means for selectively directly contacting and actuating said release means upon detection of said low speed emergency condition, said solenoid tripper being passive at all times other than upon detection of said emergency condition; and g) controller means for controlling operation of the elevator, said controller means being connected to said solenoid tripper and operable to activate the latter only upon detection of said emergency condition.

2. The assembly of claim 1 further comprising first sensor means on the elevator car for detecting a car door open condition and second sensor means for detecting movement of the car away from a landing, said first and second sensor means being connected to said controller means and operable to signal said controller means of concurrent door open car movement.

3. The assembly of claim 1 wherein said release means comprising fixed stop means formed thereon and aligned with said solenoid tripper, said stop means forming a reaction surface on said release means for engagement by said solenoid means where the release means is tripped by said solenoid tripper.

4. The assembly of claim 1 wherein said solenoid tripper is normally deenergized, and wherein said controller is operable to energize said solenoid tripper to actuate said release means.

* * * * *